US010849474B2

(12) United States Patent
Hwang et al.

(10) Patent No.: US 10,849,474 B2
(45) Date of Patent: Dec. 1, 2020

(54) CLEANER

(71) Applicant: LG ELECTRONICS INC., Seoul (KR)

(72) Inventors: Philjae Hwang, Seoul (KR); Mantae Hwang, Seoul (KR); Dongseok Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 553 days.

(21) Appl. No.: 15/435,341

(22) Filed: Feb. 17, 2017

(65) Prior Publication Data

US 2017/0238777 A1 Aug. 24, 2017

(30) Foreign Application Priority Data

Feb. 18, 2016 (KR) ..... 10-2016-0018865

(51) Int. Cl.

| | |
|---|---|
| ***A47L 9/06*** | (2006.01) |
| ***A47L 5/34*** | (2006.01) |
| ***A47L 9/14*** | (2006.01) |
| ***A47L 9/32*** | (2006.01) |
| ***A47L 13/256*** | (2006.01) |
| ***A47L 13/22*** | (2006.01) |
| ***A47L 7/00*** | (2006.01) |
| ***A47L 11/20*** | (2006.01) |
| ***A47L 13/12*** | (2006.01) |

(52) U.S. Cl.

CPC ..... *A47L 9/0686* (2013.01); *A47L 5/34* (2013.01); *A47L 7/0009* (2013.01); *A47L 9/066* (2013.01); *A47L 9/1409* (2013.01); *A47L 9/325* (2013.01); *A47L 11/201* (2013.01); *A47L 13/12* (2013.01); *A47L 13/22* (2013.01); *A47L 13/256* (2013.01)

(58) Field of Classification Search

None

See application file for complete search history.

(56) References Cited

U.S. PATENT DOCUMENTS

2004/0134025 A1* 7/2004 Murphy ..... A47L 5/24 15/403

2005/0262661 A1 12/2005 Baer et al.

FOREIGN PATENT DOCUMENTS

| | | | |
|---|---|---|---|
| CN | 1555752 | A | 12/2004 |
| CN | 201295200 | Y | 8/2009 |
| CN | 203987889 | U | 12/2014 |
| CN | 204246065 | U | 4/2015 |
| EP | 1600092 | | 11/2005 |

(Continued)

OTHER PUBLICATIONS

Eng Trans of CN 204246065, attached as pdf (Year: 2015).*

(Continued)

*Primary Examiner* — Brian D Keller

(74) *Attorney, Agent, or Firm* — Fish & Richardson P.C.

(57) ABSTRACT

A cleaner includes a cleaner body including a main cleaning unit for generating suction force, a nozzle assembly rotatably connected to the cleaner body and including a suction port for sucking in air and dust, and an auxiliary cleaning unit connected to the nozzle assembly and including a cloth supporter to which a cloth is attached. The nozzle assembly includes a front wheel and a rear wheel spaced apart from the front wheel, and a shaft of the rear wheel is relatively movably connected to the nozzle assembly to change a contact area between the cloth and a floor.

20 Claims, 8 Drawing Sheets

(56) References Cited

FOREIGN PATENT DOCUMENTS

| | | |
|---|---|---|
| JP | 2005-066169 | 3/2005 |
| JP | 2006255148 | 9/2006 |
| KR | 10-2001-0028651 | 4/2001 |
| WO | 2008096949 | 8/2008 |
| WO | 2013165033 | 11/2013 |

OTHER PUBLICATIONS

Extended European Search Report in European Application No. 17156672.2, dated Jul. 21, 2017, 6 pages (with English translation).
European Search Report in European Application No. 18179347.2, dated Oct. 24, 2018, 10 pages.

* cited by examiner

CLEANER

CROSS-REFERENCE TO RELATED APPLICATION

This application claims priority under 35 U.S.C. 119 and 365 to Korean Patent Application No. 10-2016-0018865, filed on Feb. 18, 2016 in the Korean Intellectual Property Office, the disclosure of which is incorporated herein by reference.

TECHNICAL FIELD

The present invention relates to a cleaner.

BACKGROUND ART

In general, a cleaner refers to a device for sucking or mopping dust and foreign materials from a region to be cleaned to perform cleaning.

Such a cleaner may be classified into a manual cleaner for performing cleaning by user manipulation or an automatic cleaner for autonomously performing cleaning.

In addition, the manual cleaner may be classified into a canister type cleaner, an up-right type cleaner, a handheld type cleaner, a stick type cleaner, etc. according to the shape of the cleaner.

In the related art, a mop cleaner having a water sprayer is disclosed in Korean Patent Publication No. 2001-0028651 (Publication date: Apr. 6, 2001).

In the related art, a cloth is attached to the bottom of a water bottle having a water sprayer mounted therein. In the related art, the cloth moves in a state of contacting a floor, thereby cleaning the floor.

In the related art, air cannot be sucked from the floor and technology for minimizing friction between the mop and the floor upon sucking in dust through air suction to easily move the water mop device is not considered.

SUMMARY

An object of the present invention is to provide a cleaner capable of improving mobility thereof on a floor when cleaning the floor using a method of sucking dust from the floor.

Another object of the present invention is to provide a cleaner capable of improving cleaning efficiency upon cleaning a floor using a mop.

According to an aspect of the present invention, a cleaner includes a cleaner body including a main cleaning unit for generating suction force, a nozzle assembly rotatably connected to the cleaner body and including a suction port for sucking in air and dust, and an auxiliary cleaning unit connected to the nozzle assembly and including a cloth supporter to which a cloth is attached. The nozzle assembly includes a front wheel and a rear wheel spaced apart from the front wheel, a shaft of the rear wheel is relatively movably connected to the nozzle assembly to change a contact area between the cloth and a floor, and the nozzle assembly includes a plurality of shaft supporters supporting the shaft of the rear wheel and an elastic member for applying elastic force to the shaft supported by the shaft supporters.

A guide groove for receiving the shaft and enabling relative movement of the shaft and the shaft supporters may be provided in each of the plurality of shaft supporters, and the elastic member may be located in the guide groove.

The elastic member may be located between an upper surface of the guide groove and the shaft.

The contact area between the cloth and the floor when the shaft is located at a first position in the guide groove may be less than the contact area between the cloth and the floor when the shaft is located at a second position in the guide groove.

According to another aspect of the present invention, a cleaner includes a cleaner body including a main cleaning unit for generating suction force, a nozzle assembly rotatably connected to the cleaner body and including a suction port for sucking in air and dust, and an auxiliary cleaning unit connected to the nozzle assembly and including a cloth supporter to which a cloth is attached. The nozzle assembly includes a front wheel and a rear wheel spaced apart from the front wheel, a shaft of the rear wheel is liftably connected to the nozzle assembly and, while the rear wheel elevates with respect to the nozzle assembly, a rear end of the cloth supporter elevates to adjust an angle between the cloth supporter and the floor, such that a contact area between the cloth and the floor is changed.

BEST MODE

Figure 1:
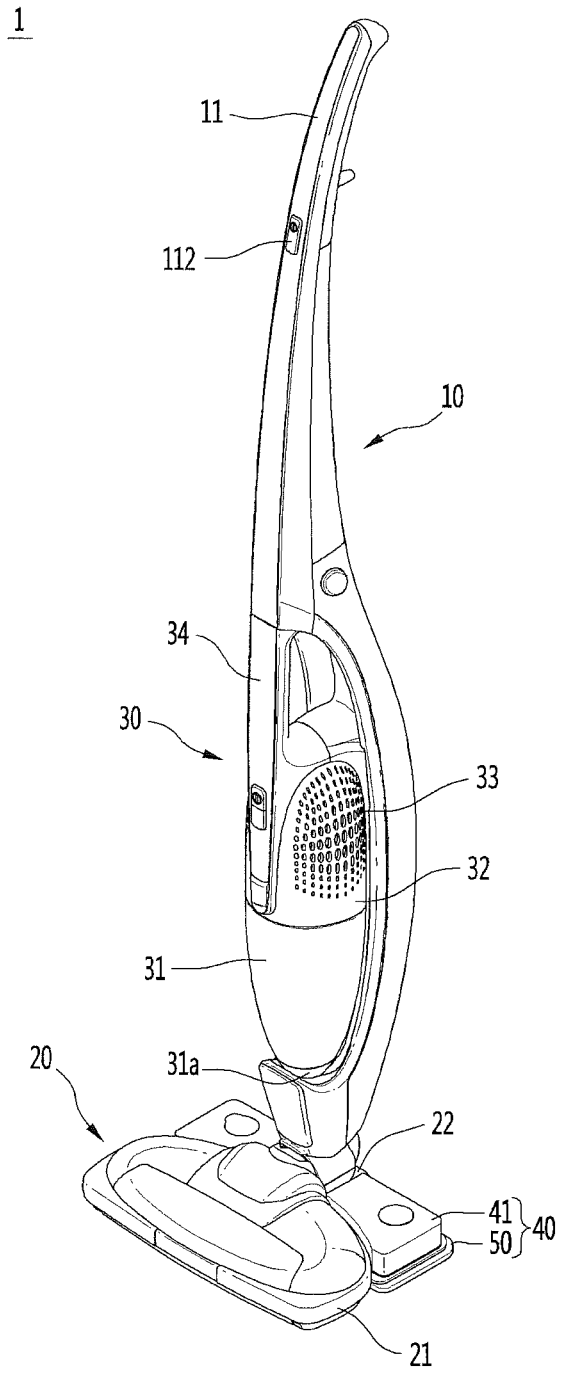
FIG. 1 is a perspective view showing a cleaner according to an embodiment of the present invention.

Hereinafter, the embodiments of the present invention will be described in detail with reference to the accompanying drawings, in which the same or similar portions are denoted by the same reference numerals. In describing the present invention, a detailed description of known functions and configurations will be omitted when it may obscure the subject matter of the present invention.

It will be understood that, although the terms first, second, A, B, (a), (b), etc. may be used herein to describe various elements of the present invention, these terms are only used to distinguish one element from another element and essential, order, or sequence of corresponding elements are not limited by these terms. It will be understood that when one element is referred to as being "connected to", "coupled to", or "access" another element, one element may be "connected to", "coupled to", or "access" another element via a further element although one element may be directly connected to or directly accessing another element.

Figure 2:
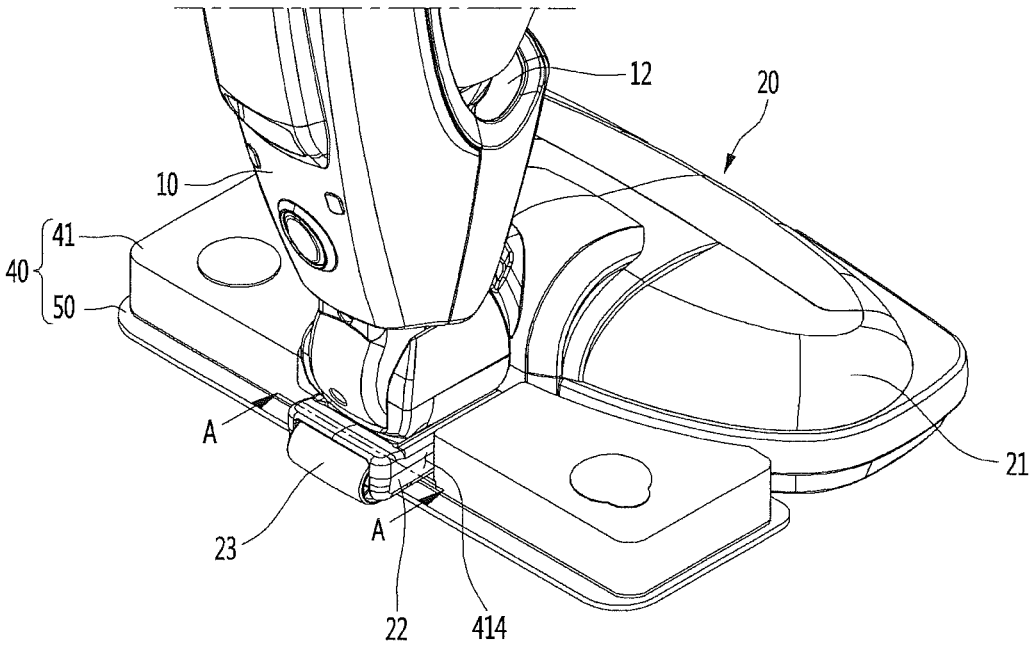
FIG. 2 is a view showing a state in which an auxiliary cleaning unit is attached to a nozzle assembly according to an embodiment of the present invention.
Figure 3:
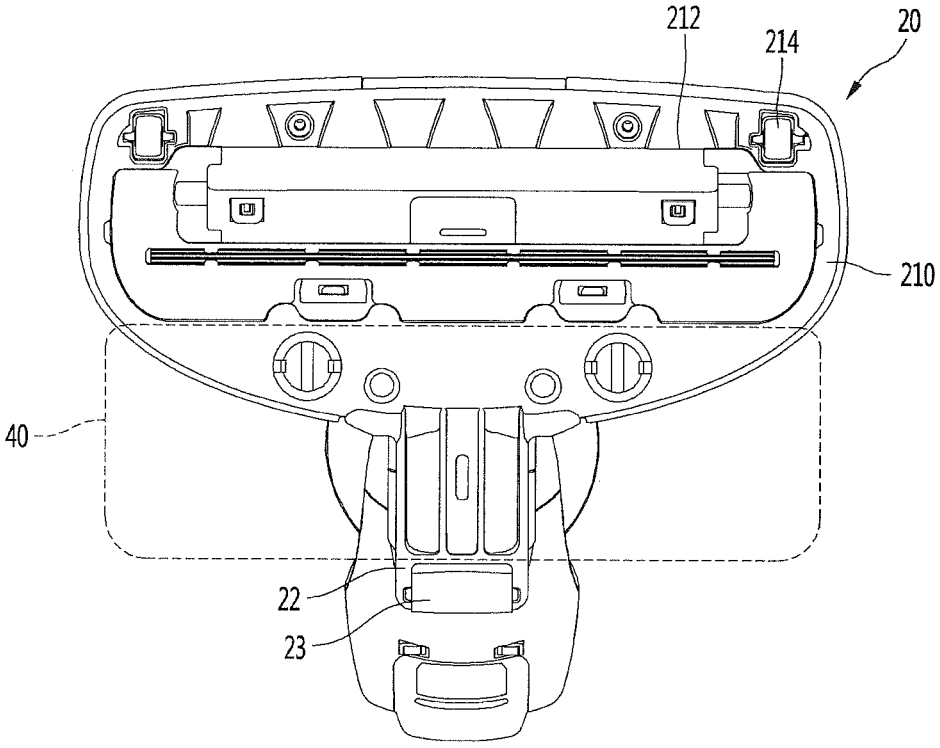
FIG. 3 is a bottom view showing a nozzle assembly according to an embodiment of the present invention.

FIG. 1 is a perspective view showing a cleaner according to an embodiment of the present invention, FIG. 2 is a view showing a state in which an auxiliary cleaning unit is attached to a nozzle assembly according to an embodiment of the present invention, and FIG. 3 is a bottom view showing a nozzle assembly according to an embodiment of the present invention.

Referring to FIGS. 1 to 3, the cleaner 1 according to the embodiment of the present invention may include a nozzle assembly 20 for sucking dust from a floor and a cleaner body 10 movably connected to the nozzle assembly 20.

Dust sucked by the nozzle assembly 20 may flow into the cleaner body 10.

The cleaner 1 may further include a main cleaning unit 30 detachably connected to the cleaner body 10.

The main cleaning unit 30 may include a body 31 including a suction motor (not shown) and a dust collector 31 detachably connected to the body 31 to store dust separated from air.

The air collector 31 may include an air inflow part 31*a* for receiving air from the cleaner body 10. The cleaner body 10 may include a communication part 12 communicating with the air inflow part 31*a*. The communication part 12 may be provided in a part in which the air inflow part 31*a* is mounted.

The air collector 31 may further include an opening and closing member (not shown) for opening and closing the air inflow part 31*a*. The opening and closing member may operate by suction force of the suction motor to open and close the air inflow part 31*a*. In contrast, when the suction motor does not operate, the opening and closing member may close the air inflow part 31*a*.

Accordingly, since the air inflow part 31*a* is closed in a state in which the suction motor does not operate, dust stored in the dust collector 31 may be prevented from being discharged through the air inflow part 31*a*.

The body 32 may include an air discharge part 33 for discharging air from the suction motor. In addition, a grip 34 grasped by a user may be provided on an upper side of the body 32.

The main cleaning unit 30 may further include a battery for supplying power to the suction motor.

Accordingly, in a state in which the main cleaning unit 30 is detached from the cleaner body 10, cleaning may be performed using the main cleaning unit 30.

In addition, in a state in which the main cleaning unit 30 is mounted in the cleaner body 10, the suction motor may operate.

The cleaner body 10 may include a handle 11 grasped by the user. A manipulation part 112 may be provided near the handle 11. The user may input a command for operating the suction motor provided in the main cleaning unit 30 or control the strength of suction force of the suction motor using the manipulation part 112.

The nozzle assembly 20 may include a nozzle body 21 and a connector 22 extending from the nozzle body 21 and rotatably connected to the cleaner body 10.

For example, the connector 22 may extend backward from the rear side of the nozzle body 21.

An auxiliary cleaning unit 40 may be coupled to the nozzle assembly 20. The auxiliary cleaning unit 40 may include a cloth supporter 41 to which a cloth 50 is attached. At this time, the cloth supporter 41 may supply water to the cloth 50.

Accordingly, the user may clean the floor using the cloth 50 which does not absorb water or clean the floor using the cloth 50 which absorbs water from the cloth supporter 41.

At this time, the cloth 50 or the bottom of the cloth supporter 41 to which the cloth 50 is attached has a planar shape to correspond to the floor F.

In the present invention, a process of performing cleaning while operating the main cleaning unit may be referred to as a first cleaning process and a process of cleaning the floor using the cloth in a state in which the cloth absorbs water regardless of the operation of the main cleaning unit may be referred to as a second cleaning process.

Although the cloth 50 may be attached to the bottom of the cloth supporter 41 by an attachment means, e.g., Velcro, the method of attaching the cloth 50 to the cloth supporter 41 is not limited thereto.

The auxiliary cleaning unit 40 may be attached to the connector 22. Of course, the auxiliary cleaning unit 40 may be additionally attached to the nozzle body 21.

In the present embodiment, as long as the auxiliary cleaning unit 40 is attached to the nozzle assembly 20, there is no limit to the structure of the nozzle assembly 20.

The auxiliary cleaning unit 40 may be disposed under the nozzle assembly 20 and at least a portion of the auxiliary cleaning unit 40 may be located outside the nozzle assembly 20 in a state of being coupled to the nozzle assembly 20.

That is, as shown in FIG. 2, a portion of the auxiliary cleaning unit 40 is disposed under the nozzle body 21 to overlap the nozzle body 21 in an upper-and-lower direction. Another portion of the auxiliary cleaning unit 40 may be disposed under the connector 22 to overlap the connector 22 in the upper-and-lower direction. Another portion of the auxiliary cleaning unit 40 may be disposed not to overlap the nozzle body 21 and the connector 22 in the upper-and-lower direction.

Accordingly, according to the present embodiment, as the portion of the auxiliary cleaning unit 40 is located outside the nozzle assembly 20 in a state in which the auxiliary cleaning unit 40 is coupled to the nozzle assembly 20, the area of the cloth supporter 41 to which the cloth 50 is attached may increase and, as a result, the contact area between the cloth 50 and the floor may increase.

According to the present embodiment, the cleaning area of the cloth 50 may increase, improving cleaning efficiency.

In addition, when the cleaner 1 is lifted up in a state of stepping on the part of the auxiliary cleaning unit 40 located outside the nozzle assembly 20, the auxiliary cleaning unit 40 may be detached from the nozzle assembly 20.

Accordingly, the user may easily detach the auxiliary cleaning unit 40 from the cleaner 1. In addition, a detachment structure may not be formed in the auxiliary cleaning unit 40 in order to detach the auxiliary cleaning unit 40.

In addition, in a state in which the auxiliary cleaning unit 40 is attached to the nozzle assembly 20, the contact area between the cleaner 1 and the floor increases such that the cleaner 1 is stably erected on the floor in the standby state of the cleaner 1.

The nozzle body 21 may include a suction port 212 for sucking in air and dust.

In addition, one or more front wheels 214 for moving the nozzle assembly 20 may be provided in the nozzle body 21. One or more rear wheels 23 for easily moving the nozzle assembly 20 may be provided in the connector 22.

That is, the nozzle assembly 20 may include a plurality of wheels 23 and 214. The plurality of wheels 23 and 214 may include one or more front wheels 214 provided in the nozzle body 21 and one or more rear wheels 23 provided in the connector 22.

A plurality of front wheels 214 may be provided in the nozzle body 21 in order stably move the nozzle assembly 20. The plurality of front wheels 214 may be spaced apart from each other in a left-and-right direction.

In order to prevent the auxiliary cleaning unit 40 from clogging the suction port 212, the auxiliary cleaning unit 40 may be located at the rear side of the suction port 212. In addition, in order to prevent interference between the auxiliary cleaning unit 40 and the plurality of wheels 23 and 214, the auxiliary cleaning unit 40 may be located at the rear side of the front wheels 214 and at the front side of the rear wheels 23.

That is, in a state in which the auxiliary cleaning unit 40 is attached to the nozzle assembly 20, the auxiliary cleaning unit 40 may be located between the front wheels 214 and the rear wheels 23. In addition, the auxiliary cleaning unit 40 may be located between the suction port 212 and the rear wheels 23.

One or more water containers for storing water may be formed in the cloth supporter 41. A space 414 in which the connector 22 of the nozzle assembly 20 is located may be formed in the cloth supporter 41.

Figure 4:
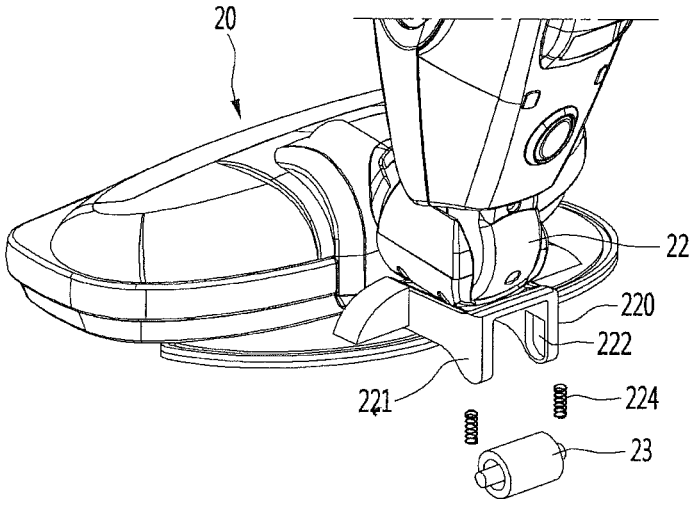
FIG. 4 is a view showing a state in which a rear wheel is detached from a nozzle assembly according to an embodiment of the present invention.
Figure 5:
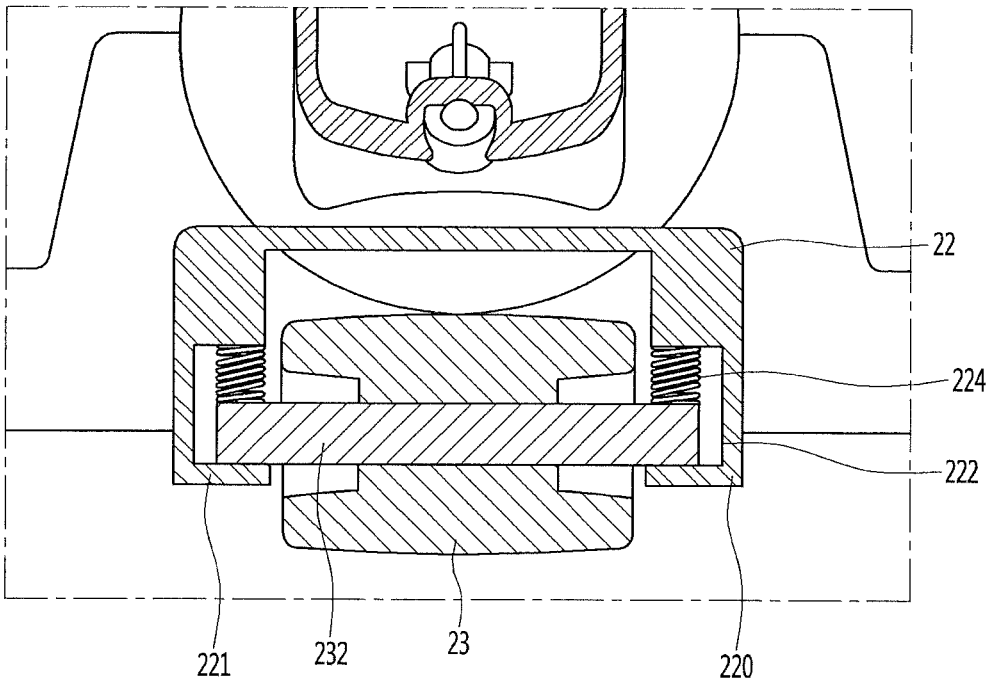
FIG. 5 is a cross-sectional view taken along line A-A of FIG. 2.

FIG. 4 is a view showing a state in which a rear wheel is detached from a nozzle assembly according to an embodiment of the present invention, and FIG. 5 is a cross-sectional view taken along line A-A of FIG. 2.

Referring to FIGS. 4 and 5, the shaft 232 of the rear wheel 23 may be relatively movably connected to the nozzle assembly 20 such that the contact area between the cloth 50 and the floor can be changed.

For example, the shaft 232 of the rear wheel 23 may be relatively movably connected to the connector 22.

The shaft 232 may penetrate through the rear wheel 23 and rotate along with the rear wheel 23.

The connector 22 may include shaft supporters 220 and 221 supporting the shaft 232. The shaft supporters 220 and 221 may include a first supporter 220 supporting the first end of the shaft 232 and a second supporter 220 spaced apart from the first supporter 220 and supporting the second end of the shaft 232.

That is, the rear wheel 23 may be located between the first supporter 220 and the second supporter 221.

The supporters 220 and 221 may rotatably support the shaft 232.

Guide grooves 222 for vertically moving the supporters 220 and 221 relative to the shaft 232 are provided in the supporters 220 and 221. Both ends of the shaft 232 may be received in the guide grooves 222 of the supporters 220 and 221. The guide grooves 222 may extend in the upper-and-lower direction.

An elastic member 224 may be located in the guide groove 222 of the supporter 220 or 221. The elastic member 224 may provide the nozzle assembly 20 with force for lifting the nozzle assembly 20 up in a state of contacting the shaft 232.

For example, the elastic member 224 may be located between the upper surface of the guide groove 222 and the shaft 232. The upper end of the elastic member 224 may contact the inner surface of the guide groove 222 and the lower end of the elastic member 224 may contact the shaft 232, without being limited thereto.

As the shaft 232 is located in the guide groove of the supporter 220 or 221, the relative positions of the shaft 232 and the connector 22 may be changed in a state in which the rear wheel 23 contacts the floor.

Figure 6:
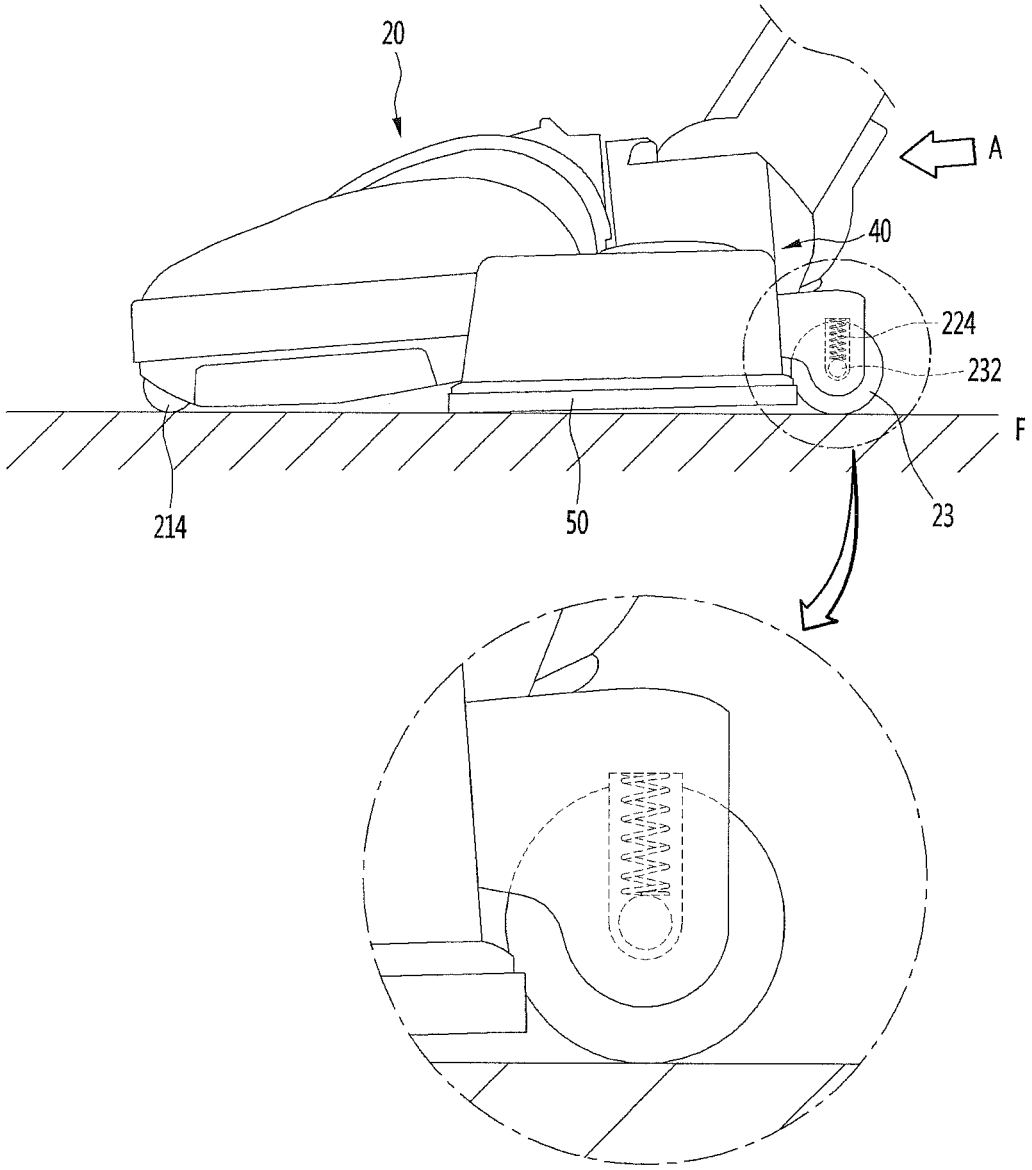
FIG. 6 is a view showing a positional relationship between a mop and a floor in a first cleaning process.
Figure 7:
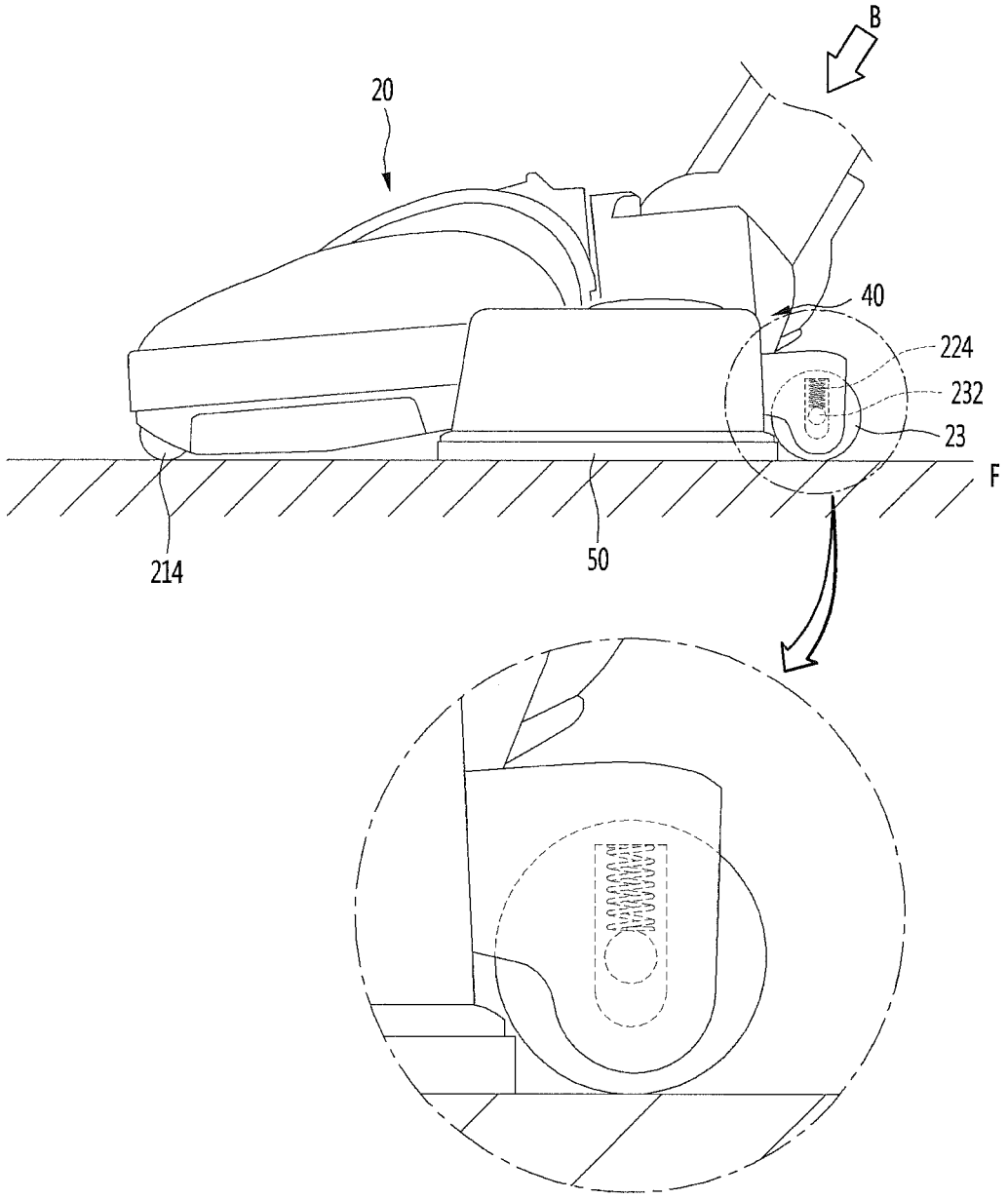
FIG. 7 is a view showing a positional relationship between a mop and a floor in a second cleaning process.

FIG. 6 is a view showing a positional relationship between a cloth and a floor in a first cleaning process, and FIG. 7 is a view showing a positional relationship between a cloth and a floor in a second cleaning process.

First, referring to FIG. 6, when the user sucks dust from the floor F to clean the floor F without using the cloth 50, that is, in the first cleaning process, external force is appropriately applied to the nozzle assembly 20 in a direction denoted by arrow A.

In general, in the first cleaning process, the user is not interested in removing stains from the floor, most of the force applied to the nozzle assembly 20 acts as force for moving the nozzle assembly 20 forward or backward.

If external force is applied to the nozzle assembly 20 in the direction denoted by arrow A, external force may be concentrated on the front wheel 214 of the nozzle assembly 20.

In this case, since elastic force of the elastic member 224 is applied to the shaft 232, the rear wheel 23 may contact the floor F. In addition, since elastic force of the elastic member 224 is also applied to the nozzle assembly 20, the shaft 232 of the rear wheel 23 is located at the lower end of the guide groove 222.

Of course, when the nozzle assembly 20 moves forward (to the left in FIG. 6), the rear wheel 23 may be separated from the floor F in the direction of external force applied by the user.

In the present invention, a distance between one point of the bottom of the connector 22 and the floor when the shaft 232 of the rear wheel 23 is located at the lower end of the guide groove 222 may be referred to as a first distance.

In addition, when the shaft 232 of the rear wheel 23 is located at the lower end of the guide groove 222, the shaft 232 may be located at a first position in the guide groove 222.

When the shaft 232 of the rear wheel 23 is located at the lower end of the guide groove 222, that is, when the distance between one point of the bottom of the connector 22 and the floor is the first distance, a portion of the cloth 50 attached to the cloth supporter 41 may contact the floor F and the other portion thereof may be separated from the floor F.

When the cloth 50 is bisected into a front end and a rear end in the front-and-rear direction of the nozzle assembly 20 (in FIG. 6, in the left-and-right direction), at least a portion of the front end of the cloth 50 may contact the floor 50 and at least a portion of the rear end of the cloth 50 may be separated from the floor 50.

In this state, since the contact area between the cloth 50 and the floor is minimized, resistance caused by friction between the cloth 50 and the floor is minimized such that the nozzle assembly 20 is smoothly moved on the floor.

As shown in FIG. 7, when stains on the floor F are to be removed using the cloth absorbing water, that is, in the second cleaning process, some of force applied to the nozzle assembly 20 acts as force for moving the nozzle assembly 20 forward or backward and the other force acts as force for pressing the nozzle assembly 20 toward the floor F.

For example, in the second cleaning process, external force is applied to the nozzle assembly 20 in a direction denoted by arrow B.

When external force is applied to the nozzle assembly 20 in the direction denoted by arrow B, some of external force is applied to the elastic member 224.

In this case, since the elastic member 224 is contracted in a state in which the rear wheel 223 contacts the floor F, the nozzle assembly 20 moves downward such that the shaft 232 of the rear wheel 23 is separated from the end of the guide groove 223. For example, the shaft 232 of the rear wheel 23 may be located at the center of the guide groove 223.

In the present invention, a distance between one point of the bottom of the connector 22 and the floor F when the shaft 232 of the rear wheel 23 is separated from the lower end of the guide groove 222 may be referred to as a second distance. The second distance is less than the first distance.

In addition, when the shaft 232 of the rear wheel 23 is separated from the lower end of the guide groove 222, the shaft 232 may be located at a second position in the guide groove 222.

The distance (second distance) between one point of the bottom of the connector 22 and the floor when the shaft 232 of the rear wheel 23 is separated from the lower end of the guide groove 222 is less than the distance (first distance) between one point of the bottom of the connector 22 and the floor when the shaft 232 of the rear wheel 23 is located at the lower end of the guide groove 222, the whole of the cloth 50 attached to the cloth supporter 41 contacts the floor F.

In this case, as the whole of the cloth 50 contacts the floor F, the cleaning area of the cloth 50 may increase to efficiently remove stains from the floor F.

In the state shown in FIG. 7, when external force applied to the elastic member 224 is reduced, the shaft 232 of the rear wheel 23 is located at the lower end of the guide groove 222 and the distance between one point of the bottom of the connector 222 and the floor increases.

In addition, referring to FIGS. 6 and 7, the shaft 232 of the rear wheel 23 is liftably connected to the nozzle assembly 20 and, while the rear wheel 23 elevates with respect to the nozzle assembly 20, the rear end of the cloth supporter 41 elevates to adjust the angle between the cloth supporter 41 and the floor F, thereby changing the contact area between the cloth 50 and the floor F.

Unlike the above description, according to the length of the strands of the cloth, the thickness of the cloth supporter and a distance between the bottom of the nozzle assembly and the floor, the whole of the cloth may be separated from the floor F in the first cleaning process.

In addition, according to the length of the strands of the cloth, the thickness of the cloth supporter and a distance between the bottom of the nozzle assembly and the floor, the whole of the cloth may contact the floor F in a substantially erected state in the first cleaning process.

In the second cleaning process, the ends of the strands of the cloth may contact the floor F in a state in which the strands of the cloth lie. That is, the contact area between the strands of the cloth and the floor F in the second cleaning process may be greater than the contact area between the strands of the cloth and the floor F in the first cleaning process.

According to the present invention, when the floor is cleaned by sucking dust from the floor, the contact area between the cloth and the floor may be minimized to improve mobility of the cleaner on the floor.

When the floor is cleaned using the cloth, the distance between the nozzle assembly and the floor may decrease and the contact area between the cloth and the floor increases, thereby easily removing stains from the floor.

In addition, since the distance between the nozzle assembly and the floor may decrease in a direction of applying external force without user manipulation, it is possible to improve user convenience.

Figure 8:
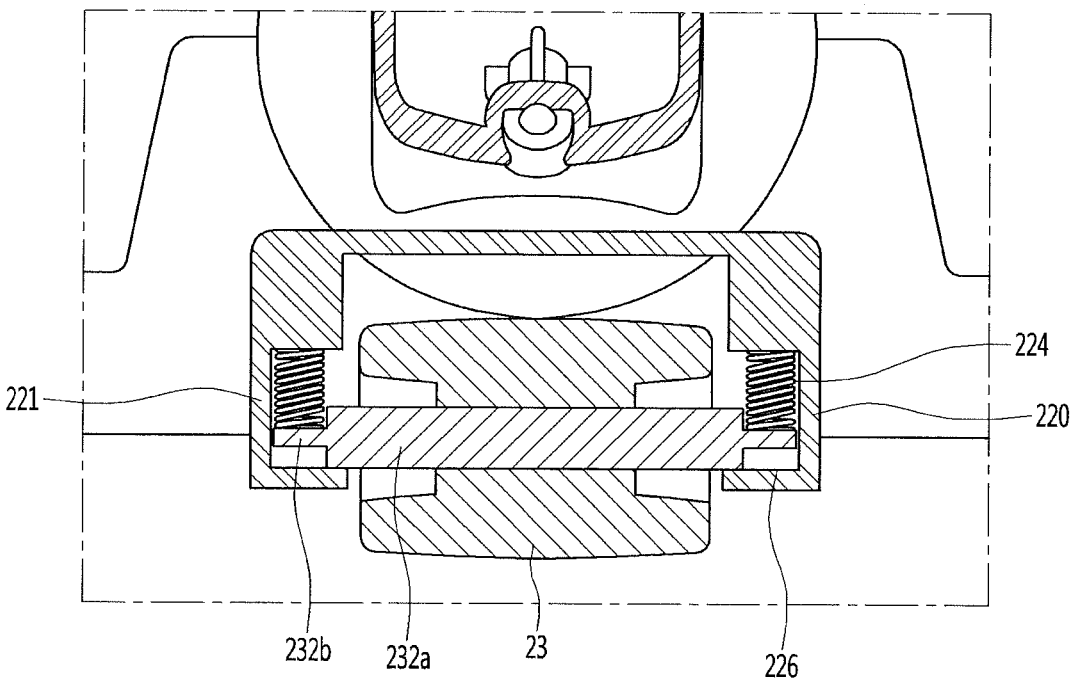
FIG. 8 is a cross-sectional view taken along line A-A of FIG. 2 according to another embodiment of the present invention.

FIG. 8 is a cross-sectional view taken along line A-A of FIG. 2 according to another embodiment of the present invention.

This embodiment is different from the above-described embodiment in the structure of the shaft and the coupling relation between the shaft and the rear wheel. Accordingly, hereinafter, the features of this embodiment will be focused upon.

Referring to FIG. 8, the rear wheel 23 of this embodiment may be rotatably connected to the shaft 232*a*.

The shaft 232*a* may be relatively movably connected to the shaft supporters 220 and 221. That is, in this embodiment, the shaft 232*a* may not rotate and may move relative to the shaft supporters 220 and 221.

The shaft 232*a* may include an elastic member supporter 232*b* supporting the elastic member 224. The vertical cross-section of the elastic member supporter 232*b* may not be circular.

A guide groove 226 for receiving the elastic member supporter 232*b* is formed in the shaft supporter 220 or 221.

Even in the present invention, according to the magnitude of external force applied to the elastic member 224, the distance between the connector 22 and the floor F may be changed and thus the contact area between the cloth and the floor F may be changed.

Although the nozzle assembly includes the front wheel and the rear wheel in the above-described embodiment, the front wheel of the nozzle assembly may be omitted.

What is claimed is:

1. A cleaner comprising:

a cleaner body that includes a main cleaning unit that is configured to generate a suction force;

a nozzle assembly that is rotatably connected to the cleaner body and that includes a suction port that is configured to suction in air and dust; and an auxiliary cleaning unit that is connected to the nozzle assembly and that includes a cloth supporter that is configured to receive a cloth, wherein the nozzle assembly comprises:

(i) a front wheel, (ii) a rear wheel that is spaced apart from the front wheel, (iii) a shaft of the rear wheel that is connected to the nozzle assembly and that is configured to:

adjust a contact area between the cloth and a floor to a minimum area based on operating the cleaner in a first mode that includes suctioning dust through the suction port, and adjust the contact area between the cloth and the floor to a maximum area based on operating the cleaner in a second mode that includes cleaning the floor with the cloth, (iv) a shaft supporter that is configured to support the shaft of the rear wheel and that defines a guide groove configured to receive the shaft, and (v) an elastic member that is configured to apply an elastic force to the shaft, and wherein the shaft of the rear wheel comprises:

a first portion that passes through the rear wheel and that has a first vertical thickness, and a second portion that extends laterally outward from the first portion, that supports the elastic member, and that has a second vertical thickness that is less than the first vertical thickness.

2. The cleaner according to claim 1, wherein the guide groove is configured to guide movement of the shaft in a direction that is perpendicular to a center axis of the shaft and is configured to receive the elastic member.

3. The cleaner according to claim 1, wherein the elastic member is located between an upper surface of the guide groove and the shaft.

4. The cleaner according to claim 1, wherein a size of the contact area based on the shaft being located at a first position in the guide groove is smaller than a size of the contact area based on the shaft being located at a second position in the guide groove.

5. The cleaner according to claim 4, wherein at least a portion of the cloth is separated from the floor based on the shaft being located at the first position in the guide groove.

6. The cleaner according to claim 5, wherein based on the shaft being located at the first position in the guide groove, at least a portion of a front end of the cloth contacts the floor and at least a portion of a rear end of the cloth is separated from the floor.

7. The cleaner according to claim 4, wherein based on the shaft being located at the first position in the guide groove, an entire area of the cloth contacts the floor.

8. The cleaner according to claim 4, wherein a distance between a bottom of the nozzle assembly and the floor based on the shaft being located at the first position in the guide groove is larger than a distance between the bottom of the nozzle assembly and the floor based on the shaft being located at the second position in the guide groove.

9. The cleaner according to claim 4, wherein the first position in the guide groove is at a lower end of the guide groove that is nearer to the floor than an upper end of the guide groove.

10. The cleaner according to claim 1, wherein the nozzle assembly further comprises:

a nozzle body that includes the suction port and the front wheel; and a connector that extends from the nozzle body toward a back of the cleaner body, that includes the rear wheel, and that is connected to the cleaner body.

11. The cleaner according to claim 10, wherein the auxiliary cleaning unit is attached to the connector and is located between the front wheel and the rear wheel.

12. The cleaner according to claim 1, wherein either a bottom of the cloth supporter or the cloth is flat.

13. The cleaner according to claim 1, wherein the main cleaning unit includes a body that includes:

a suction motor, and a dust collector that is detachably connected to the body and that is configured to store dust.

14. The cleaner according to claim 13, wherein the body is configured to be received in the main cleaning unit, the body having a rear surface configured to face a front surface of the main cleaning unit, and wherein the cleaner body further comprises:

a handle that is disposed at an upper end of the main cleaning unit; and a grip that is disposed at a front surface of the body and that is disposed between the handle and the nozzle assembly based on the body being received in the main cleaning unit.

15. The cleaner according to claim 1, wherein the first portion of the shaft is configured to contact a top surface of the shaft supporter that defines a lower end of the guide groove.

16. The cleaner according to claim 1, wherein an end of the first portion of the shaft and the second portion of the shaft are disposed within the guide groove, wherein the first portion of the shaft has a bottom surface that is configured to contact a lower end of the guide groove, and wherein the second portion of the shaft has a top surface that supports the elastic member and a bottom surface that is spaced apart from the lower end of the guide groove.

17. The cleaner according to claim 1, wherein the shaft of the rear wheel is configured to, based on moving to a lower end of the guide groove, detach at least a portion of the cloth from the floor.

18. A cleaner comprising:

a cleaner body that includes a main cleaning unit that is configured to generate a suction force;

a nozzle assembly rotatably that is connected to the cleaner body and that includes a suction port that is configured to suction in air and dust; and an auxiliary cleaning unit that is connected to the nozzle assembly and that includes a cloth supporter that is configured to receive a cloth, wherein the nozzle assembly comprises:

(i) a wheel that is located at a rear side of the cloth supporter, (ii) a shaft of the wheel that is connected to the nozzle assembly and that is configured to:

adjust a distance between a bottom of the nozzle assembly and a floor by moving relative to the nozzle assembly, adjust a contact area between the cloth and a floor to a minimum area based on operating the cleaner in a first mode that includes suctioning dust through the suction port, and adjust the contact area between the cloth and the floor to a maximum area based on operating the cleaner in a second mode that includes cleaning the floor with the cloth, (iii) a shaft supporter that is configured to support the shaft of the wheel and that defines a guide groove configured to receive the shaft, and (iv) an elastic member that is configured to apply an elastic force to the shaft, and wherein the shaft of the wheel comprises:

a first portion that passes through the wheel and that has a first vertical thickness, and a second portion that extends laterally outward from the first portion, that supports the elastic member, and that has a second vertical thickness that is less than the first vertical thickness.

19. A cleaner comprising:

a cleaner body that includes a main cleaning unit and that is configured to generate a suction force;

a nozzle assembly that is rotatably connected to the cleaner body and that includes a suction port that is configured to suction in air and dust; and an auxiliary cleaning unit that is connected to the nozzle assembly and that includes a cloth supporter that is configured to receive a cloth, wherein the nozzle assembly includes:

(i) a front wheel, (ii) a rear wheel that is spaced apart from the front wheel, (iii) a shaft of the rear wheel that is connected to the nozzle assembly and that is configured to:

adjust an angle defined by the cloth supporter and a floor based on adjusting a distance between the rear wheel and a bottom of the nozzle assembly, adjust a contact area between the cloth and the floor to a minimum area based on operating the cleaner in a first mode that includes suctioning dust through the suction port, and adjust the contact area between the cloth and the floor to a maximum area based on operating the cleaner in a second mode that includes cleaning the floor with the cloth, and (iv) a shaft supporter that is configured to support the shaft of the rear wheel and that defines a guide groove configured to receive the shaft, and wherein the shaft of the rear wheel comprises:

a first portion that passes through the rear wheel and that has a first vertical thickness, and a second portion that extends laterally outward from the first portion and that has a second vertical thickness that is less than the first vertical thickness.

20. A cleaner comprising:

a cleaner body that includes a main cleaning unit that is configured to generate a suction force;

a nozzle assembly that is rotatably connected to the cleaner body and that includes a suction port that is configured to suction in air and dust; and an auxiliary cleaning unit that is connected to the nozzle assembly and that includes a cloth supporter that is configured to receive a cloth, wherein the nozzle assembly includes:

(i) a wheel that is located at a rear side of the cloth supporter, and (ii) a shaft of the wheel that is connected to the nozzle assembly and that is configured to:

adjust an angle defined by the cloth supporter and a floor based on adjusting a distance between the wheel and a bottom of the nozzle assembly, adjust a contact area between the cloth and the floor to a minimum area based on operating the cleaner in a first mode that includes suctioning dust through the suction port, and adjust the contact area between the cloth and the floor to a maximum area based on operating the cleaner in a second mode that includes cleaning the floor with the cloth, and (iii) a shaft supporter that is configured to support the shaft of the wheel and that defines a guide groove configured to receive the shaft, and wherein the shaft of the wheel comprises:

a first portion that passes through the wheel and that has a first vertical thickness, and a second portion that extends laterally outward from the first portion and that has a second vertical thickness that is less than the first vertical thickness.

* * * * *